United States Patent [19]

Upton

[11] 4,258,926

[45] Mar. 31, 1981

[54] HIGH TEMPERATURE WELL PACKER

[75] Inventor: Thomas E. Upton, Deer Park, Tex.

[73] Assignee: Dresser Industries, Inc., Dallas, Tex.

[21] Appl. No.: 47,971

[22] Filed: Jun. 13, 1979

[51] Int. Cl.[3] ..... F16J 15/20

[52] U.S. Cl. ..... 277/116.4; 277/230; 277/DIG. 6; 166/196

[58] Field of Search ..... 277/DIG. 6, 227, 9.5, 277/229, 230, 116.8, 102, 116.2, 116.4; 166/196

[56] References Cited

U.S. PATENT DOCUMENTS

| | | | |
|---|---|---|---|
| 2,082,113 | 6/1937 | Layne et al. | 166/10 |
| 2,134,671 | 10/1938 | Payne | 277/230 X |
| 2,743,780 | 5/1956 | Brown | 277/102 X |
| 2,836,252 | 5/1958 | Lane | 166/204 |
| 2,862,563 | 12/1958 | Thompson | 166/204 |
| 3,381,969 | 5/1968 | Crow et al. | 277/230 X |
| 4,156,533 | 5/1979 | Close et al. | 277/229 |

FOREIGN PATENT DOCUMENTS

| | | | |
|---|---|---|---|
| 446694 | 12/1974 | U.S.S.R. | 277/227 |

*Primary Examiner*—Robert S. Ward, Jr.
*Attorney, Agent, or Firm*—J. N. Hazelwood; W. R. Peoples

[57] ABSTRACT

A well packer has a mandrel assembly with a tubular packing element supported thereon between upper and lower support members that are arranged to telescopically compress the packing element upon setting of the packer. The packer is constructed to retain the mandrel assembly in a telescopically retracted position compressing the packing element longitudinally until released. The tubular packing element has a quantity of loosely packed, heat resistant, compressible material of a substantially inorganic composition. Upon setting of the packer, the packing material is compressed to a tightly compacted configuration in order to establish a fluid tight seal between the mandrel assembly and the well bore. Because of the configuration of the tubular packing element, this packer is suited for operation in wells where substantially high temperatures are prevalent.

14 Claims, 4 Drawing Figures

HIGH TEMPERATURE WELL PACKER

TECHNICAL FIELD

This invention is related to well packers for use in wells having high temperature well conditions and well products such as geothermal wells.

BACKGROUND OF THE INVENTION

Most of the prior art packers utilize packing elements made of elastomeric materials where the packers are to function in wells having nominal temperatures. Prior packers designed to function in wells with elevated temperatures are basically mechanically the same as the units utilizing elastomeric sealing members with the only exception being that the packing elements are constructed of a combination plastic and asbestos material. Generally these materials have a tightly braided asbestos fiber or a closely packed asbestos and plastic composition material and thus they are relatively hard to mechanically compress. Both of these general configurations of packing material are constructed so that when the packer is set, they will be enlarged around the exterior periphery of the packer to establish a seal within the well casing. The expanding and sealing capabilities of this configuration of sealing elements is limited because of the ability of the relatively tightly packed material to change shape and have its outer perimeter significantly enlarged. As a result of this, these types of packers do not function properly in uncased well bores.

SUMMARY OF THE INVENTION

An embodiment of the well packer of this invention includes a hydraulically settable packer mechanism which is provided with a packing element for sealing in an uncased well bore at substantially elevated temperatures such as wells containing steam.

One object of this invention is to provide a high temperature packer structure overcoming the aforementioned disadvantages of the prior art packers.

Still, one other object of this invention is to provide a well packer having sealing elements which are retained between support members of a variable outer diameter so that when the packer is set and the packing elements increase in diameter as the associated supports also increase in diameter.

Yet, another object of this invention is to provide a high temperature well packing element which consists of a quantity of heat resistant sealing material that is loosely gathered and contained within a mesh enclosure and which can increase in diameter significantly upon setting of the packer in the well bore and at the same time be compressed to a substantially tightly packed configuration to establish a fluid tight seal between the packer mandrel and the well bore for wells which are cased and also for those which are uncased.

Various other objects, advantages and features of this invention will become apparent to those skilled in the art from the following discussion, taken in conjunction with the accompanying drawing, in which:

Figure 1:
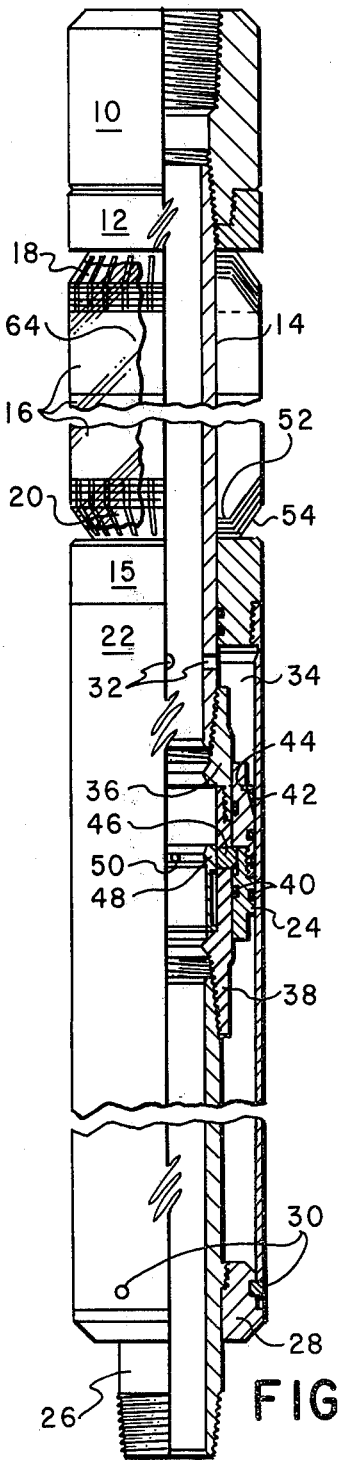
FIG. 1 is a cutaway elevation view of the well packer of this invention shown in a lengthwise shortened view with the packer in the unset or run in position.

The following is a discussion and description of preferred specific embodiments of the high temperature well packer of this invention, with such being made with reference to the drawing, whereupon the same reference numerals are used to indicate the same or similar parts and/or structure. It is to be understood that such discussion and description is not to unduly limit the scope of the invention.

DETAILED DESCRIPTION

Figure 2:
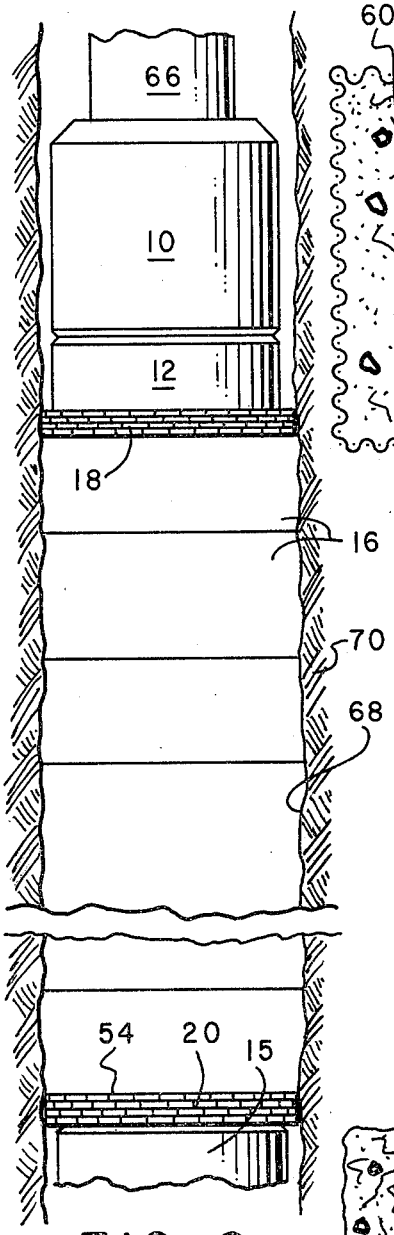
FIG. 2 is an elevation view of the mid-portion of the packer where the packer is set in an uncased well bore.
Figure 4:
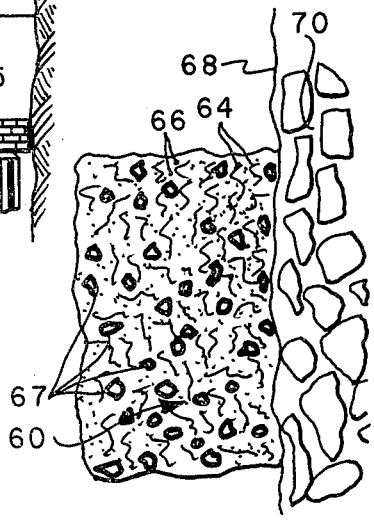
FIG. 4 is a cross-sectional elevation view of a portion of a packing element and the surrounding formation for a packing element that is set in an uncased well bore as shown in FIG. 2.

Referring to FIG. 1 of the drawing which shows the high temperature well packer of this invention, it illustrates the packer in the unset or run in positin with the packing element being positioned on the packer in an uncompressed condition between the support members. The packer is constructed to be hydraulically set once it has been properly positioned within the well bore whereupon setting of the packer longitudinally compresses the packing elements thereby radially enlarging them to seal the packer in the well bore as shown in FIGS. 2 and 4.

The packer includes a top connection 10 and an upper cap 12 secured to the upper end of the packer upper mandrel 14. A lower cap 15 is positioned around the mandrel in a spaced relation to upper cap 12. Packing elements 16 are located between the respective upper and lower support members 18 and 20. Hydraulic actuator cylinder 22 is secured to the lower side of lower cap 15 and encloses piston 24, the hydraulic actuating mechanism and the upper portion of lower mandrel 26. On the lower portion of the packer, a shoe 28 is threadedly mounted to lower mandrel 26 and secured to cylinder 22 by plurality of shear pins 30 spaced around the periphery of shoe 28. Upper mandrel 14 has a plurality of ports 32 through a mid-portion thereof to provide fluid communication with piston chamber 34 located within cylinder 22 and above piston 24.

The hydraulic actuating mechanism of this packer is provided with a latch to secure piston 24 in a fixed position for setting of the packer and to release the piston for unsetting or removal of the packer. This hydraulic actuating mechanism includes an upper adapter 36 secured to the lower end of upper mandrel 14 and a lower adapter 38 secured to the lower end of upper adapter 36 and to the upper end to lower mandrel 26. Piston 24 has annular seals around the interior and exterior thereof to seal with the exterior of adapters 36 and 38 on its interior and with the interior of cylinder 22. On the upper portion of piston 24, a segmented annular wedge 42 is provided between a tapered upper exterior portion of piston 24 around the inerior of cylinder 22. Upwardly directed teeth on wedge 42 permit cylinder 22 to move upward relative to piston 24 but engage cylinder 22 to prevent motion in the downward direction. A wedge retainer 44 mounted around piston 24 limits upward motion of wedge 42 in order to achieve a one way ratcheting action. Piston 24 is secured in the position shown by a piston lock pin 46 extending through an aperature in lower adapter 38.

Piston lock pin 46 is held in place by a piston latch sleeve 48 slidably mounted inside lower adapter 38. Piston latch sleeve 48 is secured in the position shown by a shear pin 50 mounted between the piston latch sleeve 48 and lower adapter 38. The lower exterior portion of piston latch sleeve 48 has a reduced diameter exterior portion which will permit piston lock pin 46 to move inward away from piston 24 when piston latch sleeve 48 is moved upward. Piston latch sleeve 48 is retained in a position shown until it is desired to remove the packer from the well; then an actuating tool, such as a wireline shifting tool, is passed through the tubing and the packer to a location below the piston latch sleeve 48. Next, the shifting tool is raised to engage latching surfaces on the upper interior portion of piston latch sleeve 48 so that continued upward motion will shear the shear pin 50 and allow the sleeve to be raised thereby exposing the piston latch sleeve reduced diameter exterior portion to the piston lock pin 46 so the lock pin can move inward thereby releasing piston 24 from its secured position. When this is done, cylinder 22, lower cap 15 and associated lower support member 20 can move downward relative to the packer mandrels thereby releasing compressive forces acting on the packing elements 16 so the packer can be removed from the well. Once the packer has been run, set and released then packing elements 16 must be replaced before it can be used again.

Upper and lower support members 18 and 20 are identical in construction with each one comprised of a plurality of nested basket-like members. These basket-like members each have an annular and continuous center portion 52 with a plurality of separated lever arms 54 extending outwardly around the outer perimeter thereof. Lever arms 54 are spaced segments of the outer periphery of the support member separated by slits or radially disposed slots in the support member. The individual baskets are positioned in a stacked or nested relation with the slots between the lever arms arranged to overlie the lever arms of the adjacent members. When the packer is assembled and run into the well, the support members are positioned in a frustoconical shape as shown in FIG. 1. Once the packer is set, the support members deform to a substantially planer configuration that is transverse to the elongated axis of the packer and of the well bore. This deformation increases the effective diameter of the packer for retaining the packing elements between the support members as shown in FIG. 2.

Figure 3:
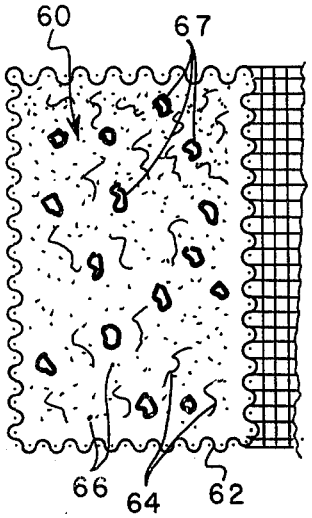
FIG. 3 is a cross-sectional elevation view taken through one side of a cylindrical packing element in a before use or unset condition.

In regard to the specific packing elements of this invention, FIG. 3 shows a cross-section through one side of a typical annular packing element in its natural or undeformed configuration. The packing element includes a quantity of high temperature resistant packing material indicated generally at 60 which is enclosed within a mesh enclosure 62. This packing material is selected to have a relatively widely spaced or somewhat fluffy consistency when the packing element is assembled and positioned within the well bore. The consistency of this material is such that the particles thereof are connected to one another but not tightly combined so that compression of the packing element a slight amount such as by finger pressure will dent or inwardly deform the packing element. When the packer is set, the packing elements are reduced in their longitudinal dimension between support members 18 and 20 until the packing material is sufficiently compacted so that continued pressure from support members 18 and 20 in the longitudinal direction will cause the packing material to flow radially outward relative to the longitudinal axis of the packer so the outer portion thereof extends to the interior surface of well bore 68 thereby forming a fluid tight seal within the formation 70.

One particular packing material suitable for use in high temperature well applications consists of particles of asbestos fiber 64, mixed with particles of mica or the like 66 and a suitable binder 67 to retain these elements together in the described consistency without becoming rigid or causing lumps of these materials within the packing element. This particular packing element is made from inorganic materials. Asbestos fiber material particles 64 and mica particles 66 are substantially interstitially spaced to form the body of the packing material with these elements being loosely connected. When this type of packer element material is used, the asbestos and its associated binding material are essentially soft or uncured when the packing element is manufactured and later installed in the well. The packing element is transformed to a harder to cured condition when the packer is set and the packing element is exposed to an elevated temperature for a period of time. Depending on the size of the packing elements and the temperture involved, the packing elements will be thermally treated to their final cured and sealed condition in the borehole. The packing material is retained within mesh enclosure 62 in order to shape and contain the packing material for use with the described packer.

Mesh enclosure 62 is a woven envelope with a cylindrical interior and exterior that are joined by a ring like segment on the top and bottom to form a complete enclosure of the ring like packing element. To totally surround the packing material, enclosure 62 can be formed of strips and annular pieces of this type of woven fabric with the pieces stitched together. Mesh enclosure 62 can be also formed by using tubular woven fabric segments with th ends of the packing element formed by cutting and overlapping the inner and outer segments of the tubular material. The fabric from which mesh enclosure 62 is made must be selected to have a sufficient spacing between the crisscrossed threads of the fabric so that it will not unduly restrict reshaping of the packing element as it occurs upon setting of the packer. More particularly, the mesh of this woven fabric must be selected sufficiently small to retain the packing material but not so small as to restrict reforming of the packing element.

For the packer shown, the upper end and lower end packing elements of the string of packing elements 16 have frustoconically formed end portions to fit within the frustoconically shaped support members 18 and 20. The remainder of the packing elements are of a cylindrical form with planner upper and lower surfaces such as shown in FIG. 3.

When the packer is assembled, the packing elements 16 are placed on upper mandrel 14 between the support members. A protective shield in the form of a tubular sleeve 64 is then fitted over the string of packing elements and portions of adjoining support members 18 and 20. Due to the rather delicate nature of the packing elements and their tendency to be deformed easily when in this preset condition, sleeve 64 forms a protective shield around the packing elements to prevent them from being damaged before the packer is set. Sleeve 64 prevents damage to the packing elements while the packer is handled before it is inserted into the well and while traveling downward through the borehole to the location at which the packer is to be set. The packer shield 64 can be a sleeve of material that shrinks when subjected to elevated temperatures thereby enabling the sleeve to be placed over the string of packing elements after assembly then heated to reduce the diameter of the sleeve to a tightly fitting configuration around the packing elements and the adjacent support members. The use of this type of sleeve will not interfere with operation of the packer because the forces present when setting the packer can easily stretch and/or burst such shrinkable tubing without effecting operation of the packer.

To set this packer at a desired location, hydraulic fluid pressure within the connecting tubing 66 is increased by any of several conventional means such as pumping a ball through the tubing to an expendable or retractable seat located below the packer thereby occluding the tubing passageway. As pressure within the tubing 66 and packer mandrel 14 increases, this increases the fluid pressure in the piston chamber 34. Because piston 24 is secured to the packer mandrel and stationary, this causes cylinder 22 to be urged in the upward direction thereby shearing the shear pins 30 connecting cylinder 22 with shoe 28. After pins 30 have sheared, cylinder 22 and associated lower cap 15 and lower support member 20 move in the upward direction thereby telescopically compressing this string of packing elements 16. As this compression occurs, packing material 60 in each of the packing elements becomes more compacted within their associated mesh enclosure 62. As this occurs, the longitudinal dimension of the string of packing elements decreases and their diametrical dimension increases to fill the annular space between the packer and well bore 68. As cylinder 22 moves upward, wedge 42 on piston 24 ratchets in a one way wedging manner to allow this upward movement but prevents cylinder 22 from moving downward in order to continue to maintain pressure on the string of packing elements. As the packing elements are compressed, support members 18 and 20 are flattened so they extend transverse to the longitudinal axis of the packer and well bore 68 as shown. Due to the pliable nature of packing material 60 and its flexible mesh enclosure 62, the packing elements easily conform to the irregularities within the interior of well bore 68 and provide a very effective fluid tight seal between the packer mandrel and this surface of formation 70. Also because of the characteristic high temperature sealing characteristics of packing material 60, the packing elements provide a fluid tight seal which will not deteriorate due to the elevated temperature which is a very common occurrence with packer elements made of an elastomeric or plastic base material even when containing asbestos or the like.

FIG. 4 shows a cutaway segment of formation 70 containing well bore 68 and an adjoining cutaway segment of packing material 60 in the compacted and sealed configuration occurring when the packer is set in fluid tight sealing contact between the packer mandrel and the formation. The packing material shown in FIG. 4 is substantially more compacted and has the elements thereof closer together than the same material in its free or uncompressed condition as shown in FIG. 3. Because the particulate packing material including asbestos fiber 64 and mica particles 66 is compressed so the elements are closely adjacent to one another in a tightly packed configuration, this establishes a non-porous bearer to well fluids in the annulus between well bore 68 and the packer mandrel.

When it is desired to remove this packer from the well, it is first necessary to release piston 24 from lower adapter 38. This is done by raising piston latch sleeve 48 thereby releasing piston lock pin 46. As described above, an appropriate shifting tool is run through the well tubing to a location below piston latch sleeve 48. Then the shifting tool is raised to shear pin 50 thereby allowing piston lock pin 46 to move inward relative to the centerline of the packer mandrel. When this has been done, piston 24 is no longer secured to lower adapter 38 so that piston 42 along with cylinder 22 can move downward on the packer mandrel thereby releasing their restraining pressure from support members 18 and 20 and the string of packing elements 16. Release of the restraining pressure on the packing elements will not apreciably change their shape or necessarily release the fluid tight seal. Upward pulling on tubing 66 will remove the packer from the well and simultaneously destroy the fluid tight seal created by the string of packing elements 16. As the packer is removed from the well, packing material 60 which has become cured and hardened by the elevated temperature will not collapse and/or elongate to pass through the well bore but it will crumble and fall away from the periphery of the packer as it is pulled upward. Upon removal of the packer from the well, it cannot be reused until the expendable components or any thermally damaged components have been replaced.

The embodiments of the invention in which an exclusive property or privilege is claimed are defined as follows:

1. In a well tool having a mandrel assembly with means thereon to mount a tubular packing element between upper and lower support members and means to telescopically compress said packing element upon operation of said well tool, an improved tubular packing element comprising:

a tubular packing element including a quantity of loosely packed, heat resistant, compressible packing material of a composition which is substantially inorganic and contained within a mesh enclosure; said packing element being adapted to be longitudinally compressed and radially expanded relative to said mandrel assembly in order to establish a fluid seal between said mandrel assembly and a well bore upon setting of said packer.

2. The tubular packing element of claim 1, wherein said packing material is an asbestos base composition material being loosely packed prior to setting of said packer and being substantially impervious to fluid when said well packer is set.

3. The tubular packing element of claim 1, wherein said packing material is of a substantially non-elastic nature, such that when compressed upon setting said packer it is not substantially expanded when said packer is released after setting.

4. The tubular packing element of claim 3, wherein said packing element has a woven asbestos fiber envelope of an annular shape enclosing said packing material.

5. The tubular packing element of claim 1, wherein said packing material remains in said loosely packed form until said packing element is telescopically compressed whereupon it becomes tightly packed, substantially impervious and forms a fluid tight seal between said mandrel assembly and said well bore.

6. A well packer having:

(a) a mandrel assembly with means thereon to mount a tubular packing element between upper and lower support members;

(b) means to telescopically compress said packing element upon setting of said packer;

(c) means to retain said mandrel assembly in a telescopically retracted position compressing said packing element until released; and (d) said tubular packing element including a quantity of loosely packed, heat resistant, compressible packing material contained within a widely spaced mesh enclosure; said packing element being adapted to be longitudinally compressed and radially expanded relative to said mandrel assembly thereby becoming tightly packed in order to establish a fluid seal between said mandrel assembly and a well bore upon setting of said packer.

7. The packer of claim 6, wherein said packing material is an asbestos base composition material comprised of widely interstitially spaced asbestos and mica particles before setting of said packer and being substantially tightly packed and fluidwise impervious when said well packer is set.

8. The packer of claim 6, wherein said packing material is of a substantially non-elastic nature, such that when compressed upon setting said packer it is not substantially expanded when said packer is released after setting.

9. The packer of claim 6, wherein said packing material in said loosely packed form is in an uncured condition until said packer is set then it becomes tightly packed, substantially impervious, forms a fluid tight seal between said mandrel assembly and said well bore, and is cured by the heated environment of the well.

10. The packer of claim 6, wherein said upper and lower support members are comprised of a plurality of levered arms carried about the mandrel support by a center portion adjacent the mandrel and adapted to move between a retracted position with said arms of one support member inclined toward the opposite support member before the packer is set and an extended position with the arms generally transverse to the longitudinal axis of the packer when the packer is set.

11. The packer of claim 10, wherein said plurality of levered arms is a nest of basket-like members with each basket member having a plurality of arm-like members extending outward around the outer periphery thereof to support the outer peripheral portion of said packing element.

12. A hydraulically set well packer comprising:

(a) a tubular mandrel assembly with means thereon to mount a tubular packing element between upper and lower support members;

(b) means to telescopically compress said packing element including a piston and cylinder means around said mandrel assembly actuatable by hydraulic pressure from within said tubular mandrel assembly;

(c) latch means with said mandrel assembly to permit telescopic retraction of said mandrel assembly for compression of said tubular packing element but prevent telescopic expansion of said mandrel assembly during setting of said well packer and during normal use thereof until released for removal of said well packer from the well bore;

(d) said tubular packing element has a quantity of loosely packed, heat resistant, compressible packing material of a composition which is substantially inorganic and contained within a large mesh enclosure of a generally tubular form; said packing element being adapted to be longitudinally compressed and radially expanded relative to said mandrel assembly in order to establish a fluid seal between said mandrel assembly and a well bore upon setting of said packer.

13. The packer of claim 12, wherein:

(a) said packing material is a pliable asbestos base composition material being porous prior to setting of said packer, being substantially impervious to fluid and relatively rigid when said well packer is set; and (b) said support members each being a plurality of nested basket-like members with each basket having a plurality of outwardly extending arms around the outer periphery thereof to support outer peripheral portions of said packing element.

14. The packer of claim 12, wherein said packing material in said loosely packed form is in an uncured condition until said packer is set then it becomes tightly packed, substantially impervious, forms a fluid tight seal between said mandrel assembly and said well bore, and is cured by the heated environment of the well.

* * * * *